US005114363A

United States Patent [19]

Mitra

[11] Patent Number: 5,114,363

[45] Date of Patent: May 19, 1992

[54] ELECTRICAL CONNECTING DEVICE AND COLORED STRIP

[75] Inventor: Niranjan Mitra, Eindhoven, Netherlands

[73] Assignee: E. I. Du Pont de Nemours and Company, Wilmington, Del.

[21] Appl. No.: 684,134

[22] Filed: Apr. 11, 1991

[30] Foreign Application Priority Data

Apr. 11, 1990 [NL] Netherlands ..... 9000856

[51] Int. Cl.[5] ..... H01R 3/00

[52] U.S. Cl. ..... 439/491; 439/488

[58] Field of Search ..... 439/488, 489, 491, 677, 439/680, 681

[56] References Cited

U.S. PATENT DOCUMENTS

| | | | |
|---|---|---|---|
| 1,936,963 | 11/1933 | Dutzmann | 439/491 X |
| 4,704,091 | 11/1987 | Owens et al. | 439/491 X |
| 4,752,245 | 6/1988 | Knecht | 439/677 |
| 4,781,619 | 11/1988 | Ikeda | 439/488 |
| 4,784,614 | 11/1988 | Sadigh-Behzadi | 439/488 |
| 4,820,193 | 4/1989 | Noorily | 439/488 |

FOREIGN PATENT DOCUMENTS

| | | | |
|---|---|---|---|
| 237388 | 2/1987 | European Pat. Off. . | |
| 336695 | 4/1989 | European Pat. Off. . | |
| 3314295 | 5/1984 | Fed. Rep. of Germany | 439/491 |
| 3744684 | 1/1989 | Fed. Rep. of Germany . | |
| 2027292 | 2/1980 | United Kingdom . | |
| 2140223 | 11/1984 | United Kingdom | 439/491 |

*Primary Examiner*—Neil Abrams
*Assistant Examiner*—Khiem Nguyen

[57] ABSTRACT

Electrical connecting device having a housing with connecting means for at least one conductor and being provided with means to be coupled to another electrical device. The housing is provided with colored identification means provided in at least one recess in the housing. The colored identification means can be introduced in this recess.

2 Claims, 1 Drawing Sheet

ELECTRICAL CONNECTING DEVICE AND COLORED STRIP

BACKGROUND OF THE INVENTION

This invention relates to an electrical connecting device comprising a housing with connecting means for at least one conductor, and means for coupling to another electrical device, the housing being provided with colored identification means.

With the increase of the packing density in electronic appliances and with the increase in functional applications of the parts of electronic circuits, components of the circuits are colored to an ever increasing extent. This also applies to electrical connecting devices. Often one and the same type of connecting device is used on the same printed circuit board and/or on other boards inside the same electronic housing of an appliance. Each of said connecting devices provides a connection within this space, but will, in general, have a different electronic function, such as power, signal, frequency differentiation etc. and it is undesirable to interchange the connections during manufacture, test or repair. In order to provide a clear distinction, each connecting device inside the appliance is provided with a separate color in order to distinguish the different electrical functions.

One way of achieving these different colors is to manufacture the connecting devices from differently colored resins. In relation to the production of such differently colored connecting devices, the costs will obviously be increased. In addition, differently colored connecting devices have to be kept in stock and the production will become less flexible because different batches have to be manufactured. Finally, between the production of two differently colored identical connecting devices, the injection molding machine has to be cleaned, with corresponding loss of material intervening between the two intended colors.

U.S. Pat. No. 4,820,193 discloses a connector in which a housing with one color is always used. The position at which the separate conductors have to be provided in the connecting device is indicated with the aid of paint dots on the housing. To protect this colored material, a cover plate over the housing is provided with openings. Such a structure is cumbersome to achieve, the working life of the color indication also being doubtful. In addition, especially in small connecting devices, great accuracy is required for positioning the codings.

SUMMARY OF THE INVENTION

The object of the present invention is to provide a connecting device which does not have the abovementioned disadvantages.

This is achieved with an electrical connecting device comprising a housing with connecting means for at least one conductor, and also means for coupling to another electrical device, in which the housing is provided with colored identification means, said colored identification means comprising a recess provided in the housing and having snap-locking means as well as a coding member which can be introduced in the recess, wherein the cross section of the recess decreases in the direction of the introduction opening and in that the coding device is a colored coding device and has a shape corresponding to the recess, and in that after introduction in the recess less than the half of the volume of the coding member projects from the recess. By mounting the coding device in a recess it is not necessary to include a cover plate for protecting the coding device. In addition, the coding device can be provided in the recess in a very simple manner without particular measures and there is no danger of the color indication being affected by wear and the like.

According to an advantageous embodiment of the invention, the coding device is cylindrical. Such a coding device can be achieved in a particularly simple manner by cutting off a certain part from a continuous strand and fitting it into the recess.

According to a further advantageous embodiment of the invention, the coding device is spherical. In that case, it is possible to provide different recesses in the electrical connecting device and, by placing differently colored spherical inserts therein, a very wide range of codings can be achieved.

With the device according to the invention, it is possible to realise codings in the final stage of the production. This is comparatively less costly compared to completely providing connecting devices with different colors and gives a better usage of the material for the connecting device.

According to a further advantageous embodiment, the recess is provided with snap-locking means. In that case, the coding device can be fitted in the recess in a particularly simple manner and fixed therein.

The coding device according to the invention may be used both to indicate the position of separate conductors with respect to a connecting device in the case in which more than one conductor has to be coupled to a connecting device and for mutually distinguishing different connecting devices.

According to a further advantageous embodiment, the at least one recess is provided near the edge of the housing. This achieves optimal visibility from different sides of the housing, which is of importance if the electrical connecting devices are received in different positions in an electrical housing.

The present invention also relates to a colored strip from which the coding devices which have to be used in the electrical connecting device which is described above can be obtained by division.

BRIEF DESCRIPTION OF THE DRAWINGS

The invention will be illustrated below with reference to an exemplary embodiment shown in the drawing. In the latter.

DETAILED DESCRIPTION OF THE EMBODIMENTS

Figure 1:
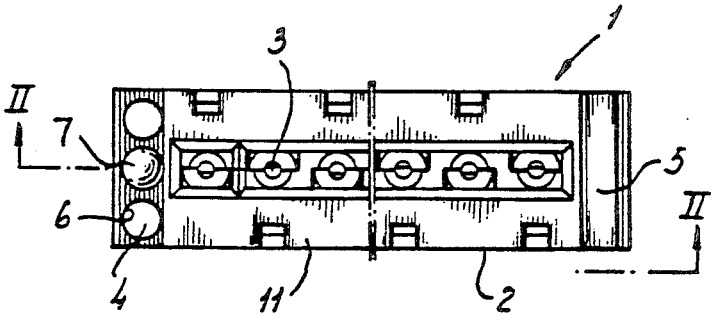
FIG. 1 shows an electrical connecting device according to the invention in plan view.
Figure 2:
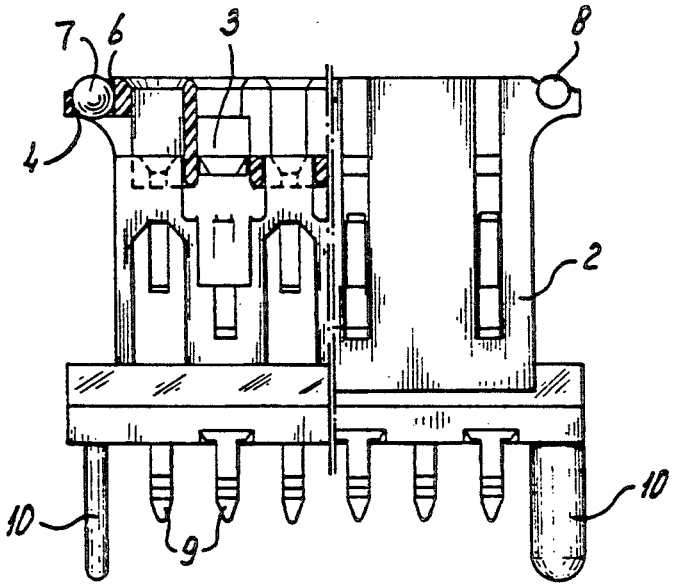
FIG. 2 shows the electrical connecting device according to FIG. 1 in side elevation and partially in section along the line II—II in FIG. 1.

In FIG. 1, an electrical connecting device is indicated as a whole by 1. It comprises a housing 2 having conductor-receiving channels 3. In the figures, the conductors, in this case a flat cable, are not depicted. Housing 2 is provided with several openings 4 at the left-hand side and with an oblong opening 5 at the right-hand side. The form of the openings 4 is more particularly evident from FIG. 2. It is evident that this is provided with a snap-locking edge 6 at the top. As is evident from FIG. 2, a spherical coding device 7 having a predetermined color is introduced into the opening 4. A cylindrical coding device 8, also having a predetermined color, is introduced into opening 5. Because several openings 4 are present, a large number of coding combinations can be achieved with a limited number of color. Sphere 7 snap-locks along the snap-locking edge 6 when introduced and is thereby secured. It is evident that both cylindrical coding device 8 and spherical coding device 7 project to some extent and, because they are provided near the edge of the housing 2, they can be observed both from above and from the side. Spherical device 7 can be manufactured in all the ways known in the prior art. The oblong coding device 8 is preferably manufactured by cutting a strand of material. Housing 2 is provided with contact pins 9 and centering pins 10.

Although not depicted here, it is also possible to provide the recess 4 or 5 in surface 11, with the result that a coding is provided for the positioning of the conductors, not depicted in more detail, with respect to the channels 3 intended therefor. Solely spherical coding devices or cylindrical coding devices may also be used at only one position in the connecting device. These and all other embodiments which are obvious to those skilled in the prior art are within the scope of the present invention.

I claim:

1. An electrical connector for interconnecting a plurality of conductors of cable with a plurality of contact elements adapted for mating with another electronic component, said connector comprising a housing of electrically insulating material, having a plurality of conductor channels for receiving said conductors and a plurality of electrical contact elements disposed so as to electrically contact respective conductors received in said conductor channels, a plurality of recesses formed in the housing for receiving different color-coded coding members for identifying said connector, at least one said recess shaped to receive a spherical coding member and having a snap-locking edge at its top to lock said spherical coding member in said recess while permitting a portion of said spherical coding member to project from said recess so as to be visible from one side of the housing, at least a second said recess having at least a partially cylindrical shape to receive a cylindrical coding member of a predetermined color, said cylindrical coding member projecting partially from said second recess so as to be visible from a second side of said connector.

2. The electrical connector of claim 1 wherein there are a plurality of said one recesses for receiving spherical coding members, each recess receiving a spherical coding member of a predetermined color, said coding members indicating the position of each conductor with respect to housing.

* * * * *